United States Patent [19]

Vischer

[11] Patent Number: 4,616,818

[45] Date of Patent: Oct. 14, 1986

[54] CARTON BLANK FEED APPARATUS

[75] Inventor: Peter Vischer, Golden, Colo.

[73] Assignee: Adolph Coors Company, Golden, Colo.

[21] Appl. No.: 714,080

[22] Filed: Mar. 15, 1985

[51] Int. Cl.[4] ..... B65H 3/32

[52] U.S. Cl. ..... 271/113; 271/117; 411/413; 411/424; 493/478

[58] Field of Search ..... 493/468, 471, 472, 475, 493/478, 479; 414/129, 330; 221/222, 277; 271/113, 117; 411/204–217, 388, 389, 413, 348, 424; 33/163

[56] References Cited

U.S. PATENT DOCUMENTS

| | | | |
|---|---|---|---|
| 389,028 | 9/1888 | Wallace | 411/389 |
| 1,142,308 | 6/1915 | Clymer et al. | 411/207 |
| 3,800,637 | 4/1974 | Scholl | 82/34 D |
| 4,429,864 | 2/1984 | Scarpa et al. | 271/97 |

*Primary Examiner*—Francis S. Husar

*Assistant Examiner*—Robert Showalter

*Attorney, Agent, or Firm*—Klaas & Law

[57] ABSTRACT

A carton separating apparatus for separating a carton from a stack of cartons comprising a rotatable body; a drive shaft connected to said rotatable body; a plate mounted axially adjacent said rotatable body; a separating blade removably attached to said plate and having a side surface facing said rotatable body and defining an axial gap therebetween adapted to receive a portion of a carton; a single screw device supporting and connecting said plate to said rotatable body and including a first threaded portion of one pitch connected to said rotatable body and a second threaded portion of another pitch connected to said plate whereby rotation of said single screw device causes differential relative axial displacement of said rotatable body and said plate while maintaining a parallel relationship between opposite gap defining surfaces thereof; and a detent device to biasingly hold said screw device in selected incremental adjusted positions.

5 Claims, 14 Drawing Figures

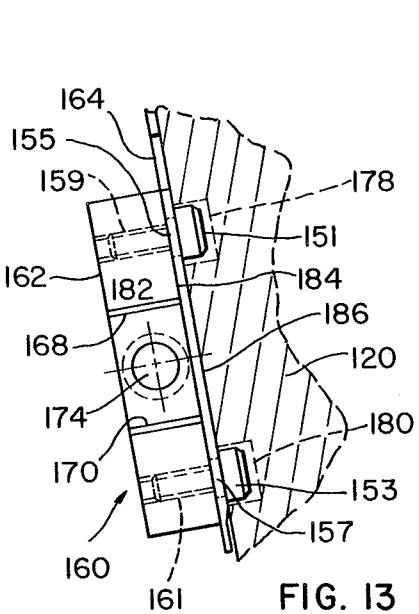
FIG. 14
FIG. 13
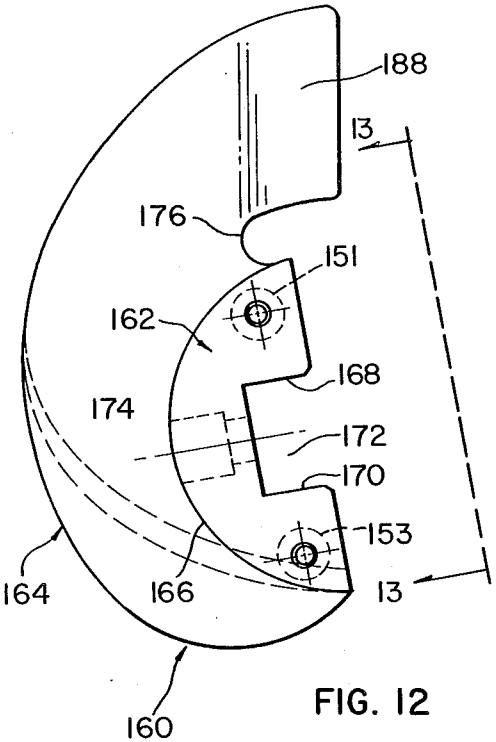
FIG. 12

CARTON BLANK FEED APPARATUS

BACKGROUND AND SUMMARY OF THE INVENTION

This invention relates to carton blank feed apparatus and, more particularly, to a new and improved adjustment mechanism therefor and assembly therefor.

In the packaging industry, flat carton blanks are formed from pre-printed flat paper packaging materials by art and score manufacturing operations. In assembly and filling, the flat carton blanks are unfolded to provide polyhedron packages to be filled with particular goods. In the beer and beverage industry, multiple container packages (e.g., six, eight, twelve, etc.) are commonly utilized.

Carton blanks for multiple container packages are somewhat bulky and subject to variation in thickness and flatness. During assembly and erection of such carton blanks, the carton blanks are stacked for feeding to assembly and erection machines. Thus, one carton of a stack of cartons must be separated from the stack of cartons for feeding to the machines.

The R. A. Jones and Company, Inc. of P.O. Box 485, Cincinnati, Ohio 45201, has developed and marketed a feed mechanism which is sold under the trademark Roto-Flo. This mechanism comprises a rotary assembly including a blade device which peels off a carton from one end of a stack of cartons. The blade device is spaced from an axially adjacent surface to provide a gap which is slightly larger than the nominal thickness of the carton which must enter the gap during the process of removal from the stack of cartons. The Roto-Flo mechanism has gap adjustment means comprising a plurality of bolts with lock nuts. In order to adjust the gap, the operation of the associated equipment must be terminated. The Roto-Flo gap adjustment mechanism required equipment down time of as much as twenty minutes. In some operations, gap adjustment may be required as often as six to eight or more times per eight hour shift. In addition, replacement of the blade device requires a substantial amount of time.

The primary object of the present invention is to provide a gap adjustment mechanism which is of simple construction and easy to operate in a small amount of time. Another object is to provide an improved assembly and mounting of the blade device whereby the blade device may be more easily assembled and removed.

In general, the present invention comprises a micrometer type gap adjustment means with only a single rotatable shaft and associated fixed pins holding the blade device on the assembly. In addition, the blade device is mounted in a manner enabling removal and replacement without disassembly of other components.

BRIEF DESCRIPTION OF DRAWINGS

FIG. 12 is an end view of a blade member of the apparatus of FIG. 3;

FIG. 13 is a side elevational view of a portion of the blade member; and

FIG. 14 is an opposite end view with respect to FIG. 12, of the blade member.

DETAILED DESCRIPTION OF THE INVENTION

Figure 1:
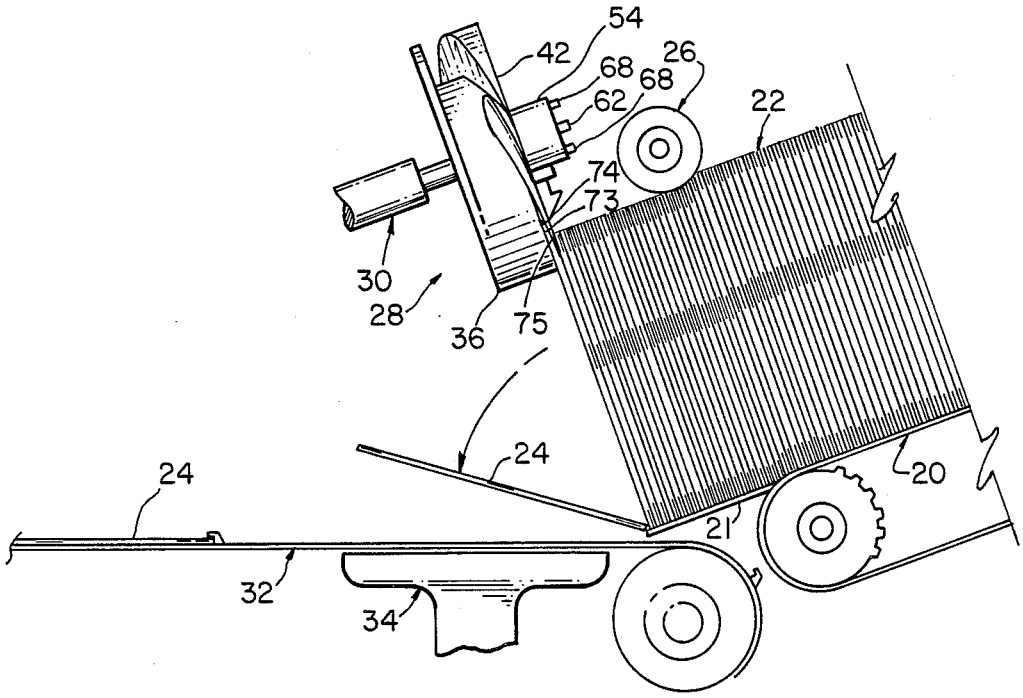
FIG. 1 is a side elevational view of a portion of a carton feed machine.
Figure 2:
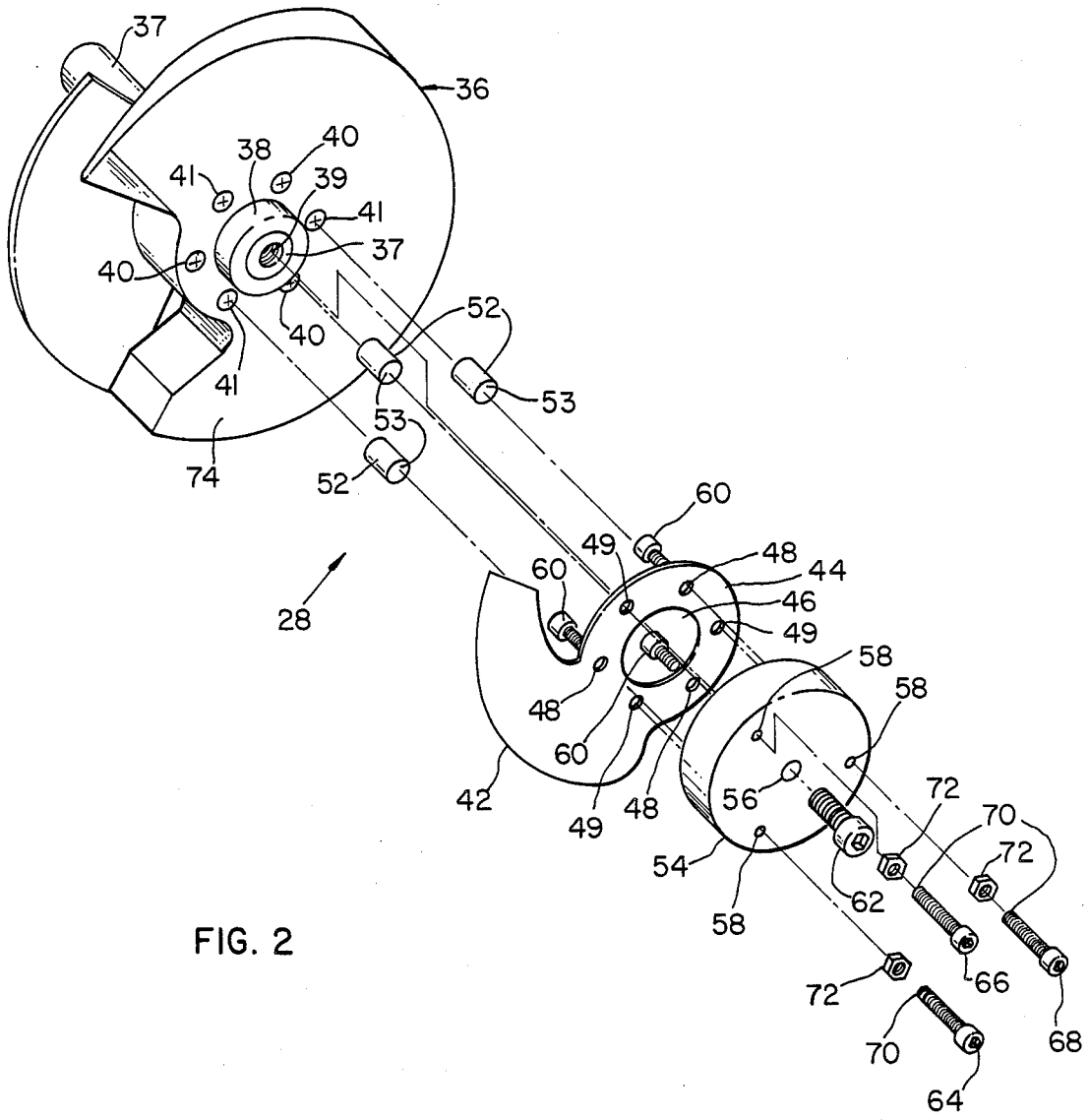
FIG. 2 is an exploded perspective view of a prior art feed device assembly.

Referring to FIG. 1, the carton feed portion of a conventional carton erecting machine is shown to comprise a downwardly inclined feed belt means 20 and inclined plate 21 for supporting a stack 22 of carton members 24. Overhead roller means 26 are provided to facilitate movement of the cartons. A rotary carton separating means 28 is mounted on an inclined drive shaft means 30 for removing one carton at a time from the stack of cartons and delivering the carton onto a conveyor belt means 32 which may have a carton detecting means 34 associated therewith. As shown in FIG. 2, the prior art rotary carton separating means 28 comprises a main rotary body assembly 36 having a hub portion 38 and shaft portion 37 with a central threaded passage 39 provided in shaft portion 37 and a plurality of circumferentially spaced threaded bolt holes 40 and dowel rod holes 41 in hub 38 provided circumjacent thereto. A blade member 42 has a central generally annular flange portion 44 with a central opening 46 adapted to be mounted over and radially adjacent to hub portion 38 and a plurality of circumferential spaced holes 48, 49 which are alignable with holes 40, 41. Three dowel members 52 are mountable in holes 41 to provide coplanar end surfaces 53 for a purpose to be hereinafter described. Blade member 42 is fixably attached to an annular end plate member 54 having a central opening 56, a plurality of circumferentially spaced circumjacent openings 58 which are alignable with openings 41 and 49 and dowels 52. Threaded bolt members 60 extend through holes 48 into aligned threaded openings (not shown) in end plate member 54. Head portions of bolt members 60 are received within bolt holes 40 in rotary body 36. A threaded bolt member 62 extends through end plate opening 56 and is threadably engageable with threaded hole 39 in shaft 37. Threaded bolt members 64, 66, 68 extend through aligned holes 58, 49 and 41 with end surfaces 70 located opposite and being abuttable with dowel rod end surfaces 53. Lock nut members 72 are mounted on bolt members 64, 66, 68 to facilitate locking adjustment thereof. Thus, a carton gap 73, FIG. 1, between surface 74 of assembly 36 and the adjacent side surface 75 of blade member 42 is adjustable by rotation of each of bolt members 64, 66, 68 which is a time consuming operation requiring substantial skill to achieve equal length axial movement of each bolt member 64, 66, 68 to maintain parallelism between surfaces 74, 75. In addition, removal and replacement of blade member 42 is a time consuming operation.

Referring now to FIGS. 3–7, the carton separating and feed means 100 of the present invention comprises a main rotary assembly 101 including a body member 102 having a central passage 104 adapted to receive a drive shaft member 106 and be fixedly attached thereto by a set screw 107. Drive shaft member 106 has a central passage 108 with a threaded portion 110. Body member 102 has a generally flat side surface 112 and a pair of dowel rod holes 114, 116. A wear plate assembly 117 is mounted on body member 102 by threaded fastening devices 118 in threaded opening 119.

Figure 3:
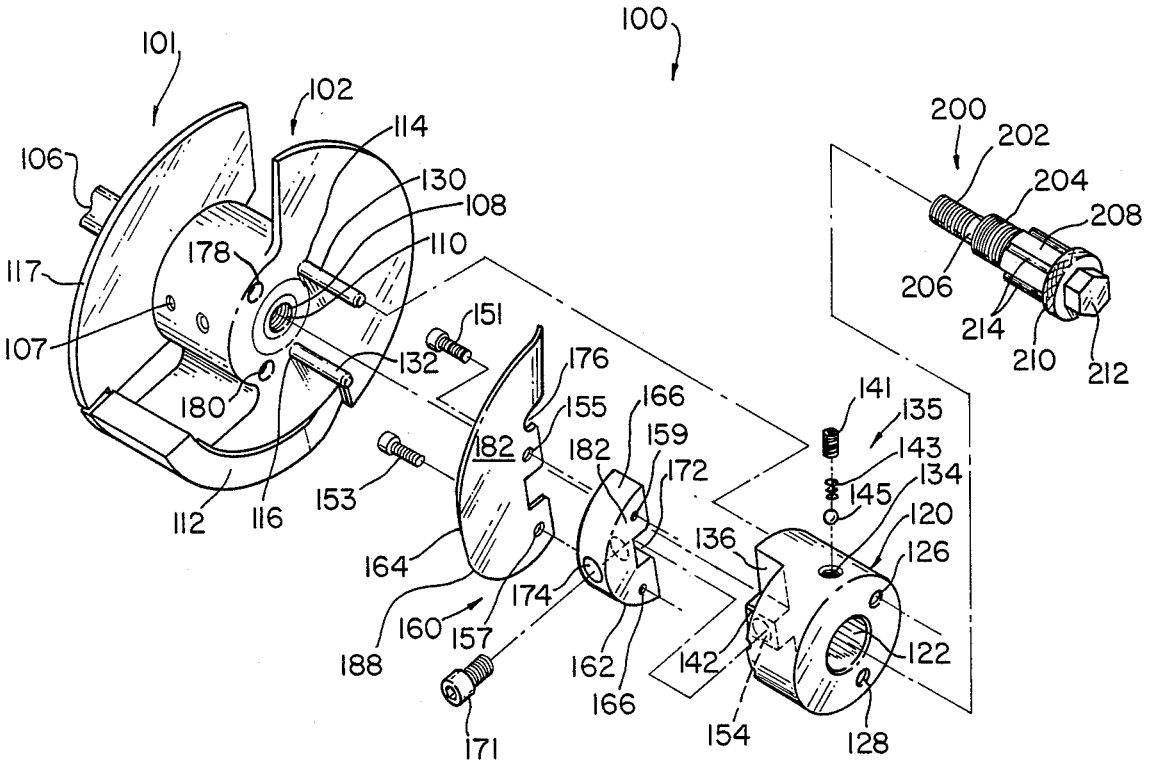
FIG. 3 is an exploded perspective view of a feed device assembly of the present invention.
Figure 4:
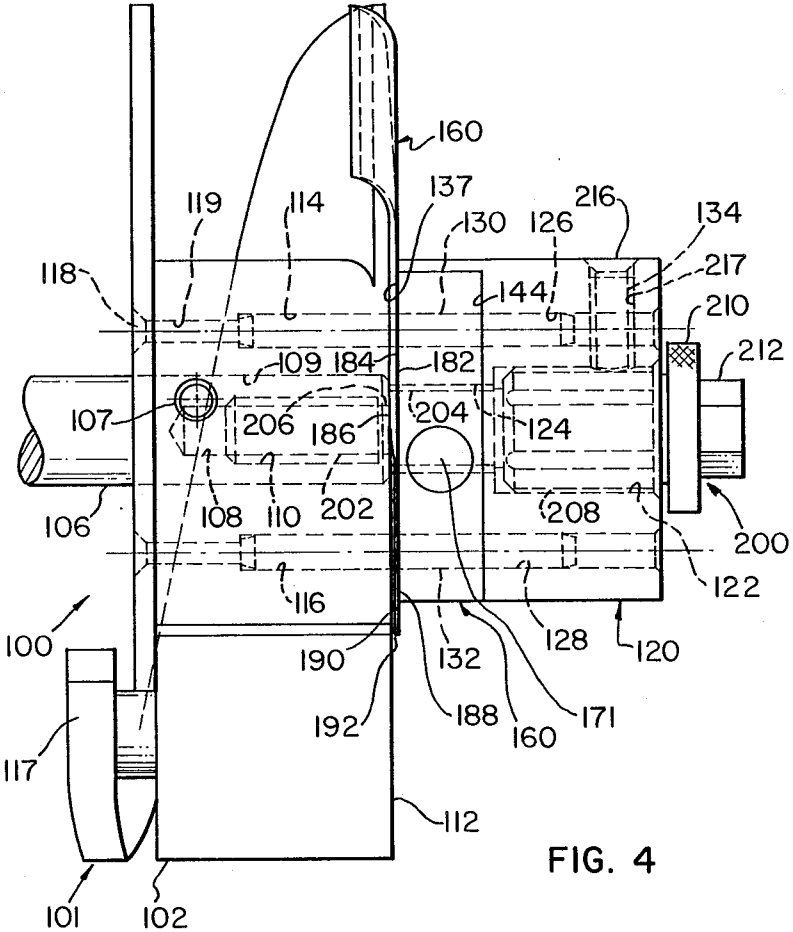
FIG. 4 is a side elevational view of the apparatus of FIG. 3.
Figure 8:
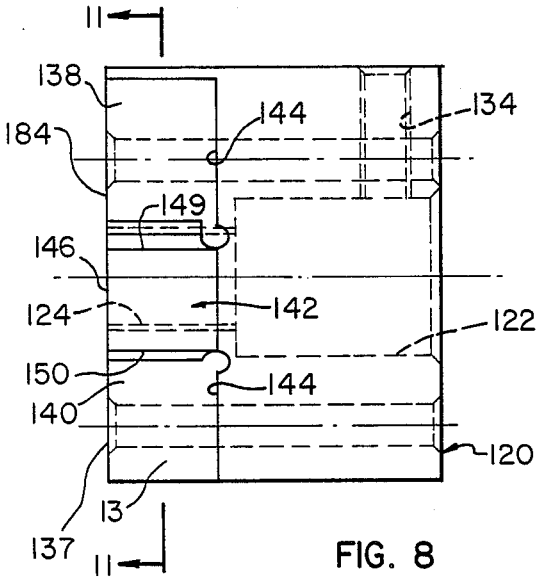
FIG. 8 is a side elevational view of an end plate member of the apparatus of FIG. 3.
Figure 9:
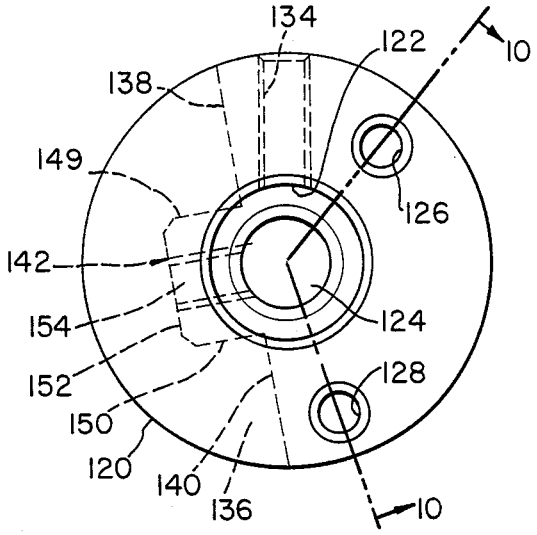
FIG. 9, is an end view of the end plate member.
Figure 11:
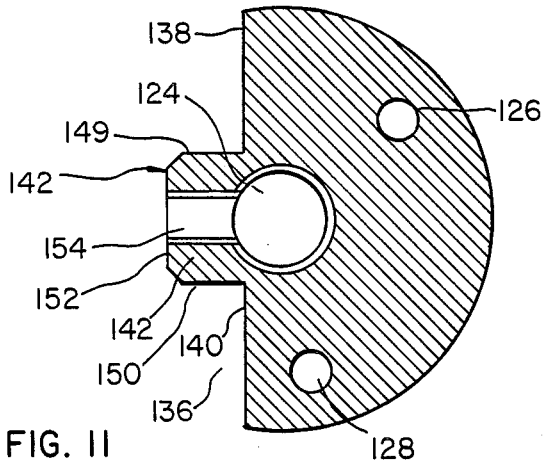
FIG. 11 is a cross-sectional view of the end plate member.
Figure 10:
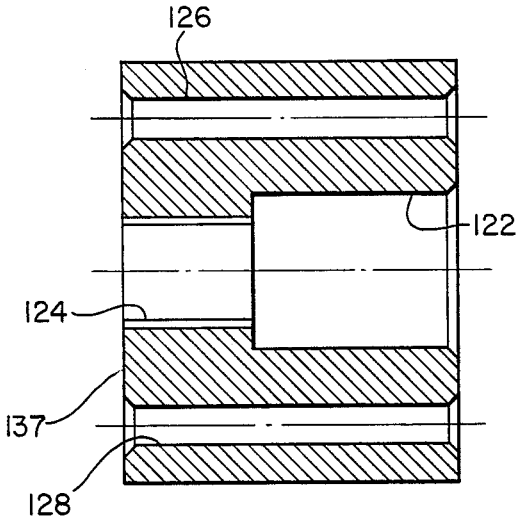
FIG. 10 is a cross-sectional view of the end plate member.

An annular end plate member 120, FIGS. 3–5 and 8–11, has a central unthreaded enlarged bore portion 122, a central threaded bore portion 124, and a pair of dowel rod holes 126, 128. Dowel rod members 130, 132, FIGS. 3 and 4, are fixedly mounted at one end portion in dowel rod holes 114, 116 in body member 102 and are slidably mounted at the other end portion in dowel rod holes 126, 128 in end plate member 120 to prevent rotation of end plate member 120 relative body member 102 and also to help maintain opposite surfaces thereat in parallel relationship. A radially extending set screw hole 134 is provided to receive a detent contacting assembly 135 including set screw 141, spring 143 and ball 145 for a purpose to be hereinafter described. Blade mounting slot means 136 are provided adjacent flat end surface 137. Slot means 136 comprises a pair of parallel flat surfaces 138, 140 on opposite sides of a rib portion 142 and a flat abutment surface portion 144. Rib portion 142 comprises flat bottom surface 146, opposite side surfaces 149, 150 and a front side surface 152. A threaded opening 154 extends into rib portion 142 through front side surface 152.

A blade means 160, FIGS. 3 and 12–14, is fixedly mounted on end plate member 120. Blade means 160 comprises a hub portion 162 and a blade portion 164 of conventional design which are fixedly attached by bolts 151, 153 in holes 155, 157 and aligned threaded bores 159, 161. Hub portion 162 has a semi-circular cross-sectional configuration defined by an arcuate surface 166 and has a pair of spaced flat parallel abutment surfaces 168, 170 defining opposite sides of a slot 172. A cap screw opening 174 is centrally located in hub portion 162, adjacent a curved slot 176 in blade means 160. Blade means 160 is fixedly mounted on annular end plate 120 in slot means 136 and about rib portion 142 by radially extending bolt 171 extending through bores 154 in end plate member 120 and associated oppositely positioned bore 174 in blade means hub portion 162. A flat side surface 182 of blade portion 164 is held in abutting engagement with flat side surface 184 of hub portion 162, as shown in FIG. 4. Opposite flat side surface 186 of blade means 160 is located opposite flat surface 112 of rotary body member 102. The blade means has a flange portion 188 of reduced thickness which provides a flat side surface 190 spaced from body member flat side surface 112 to provide a variable width gap 192 therebetween. Bores 178, 180 in rotary body member 102 provide clearance for the heads of bolts 151 and 153.

Figure 6:
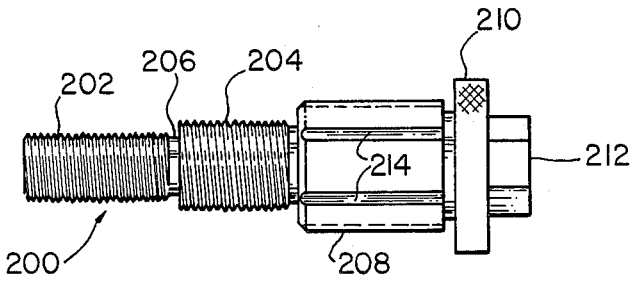
FIG. 6 is a side elevational view of an adjustment bolt of the apparatus of FIG. 3.
Figure 7:
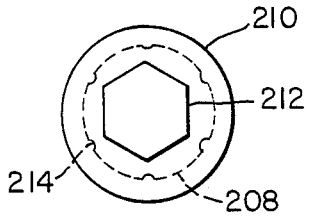
FIG. 7 is an end view of the bolt of FIG. 6.
Figure 5:
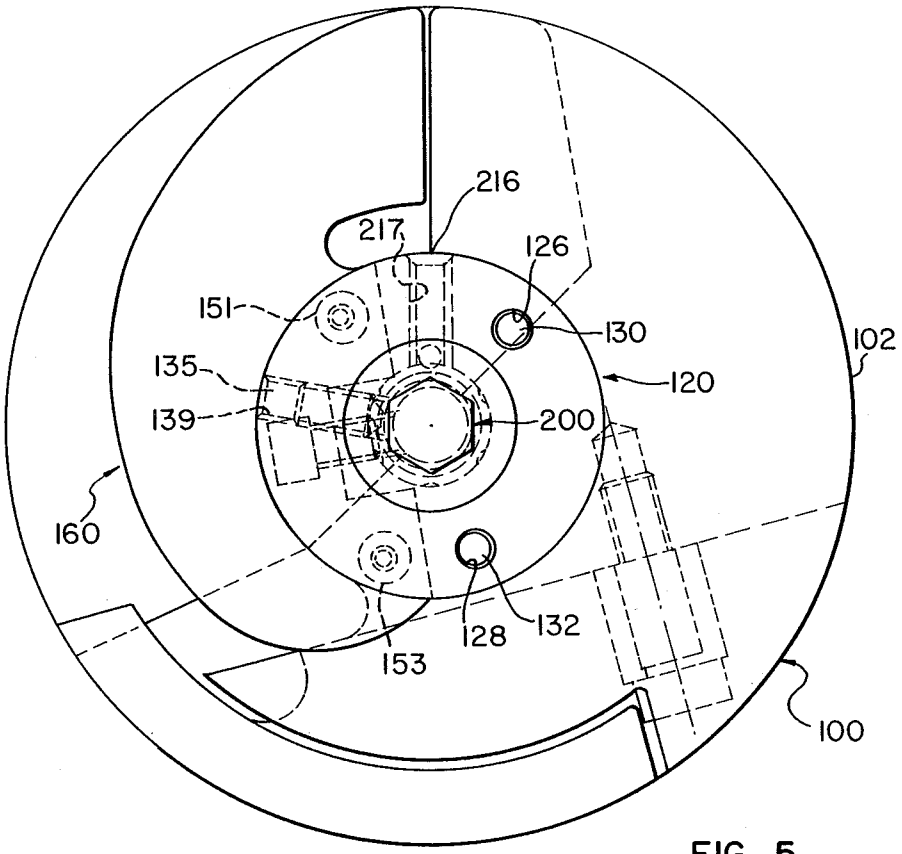
FIG. 5 is an end view of the apparatus of FIG. 3.

An adjustment screw means 200, FIGS. 3, 6 and 7, provides a differential threaded system. The screw means 200 has a first relatively small diameter threaded portion 202 threadably engaged with the threads in rotary body member bore portion 110, a second relatively large diameter threaded portion 204 threadably engaged with the threads in end plate bore portion 124, an intermediate unthreaded portion 206 freely extending between bore portions 110 and 124, an enlarged detent portion 208 located in bore portion 122, an annular thumb wheel portion 210, and an hexagonal end portion 212. Detent portion 208 has a plurality of circumferentially spaced detent slots 214 extending axially thereacross. Detent ball 145 is mounted in bore 134 and coacts with detent slots 114 to bias screw 200 in a plurality of discreet rotational positions. The threads on adjustment screw portion 202 and in bore 110 are of relatively fine thread size (small pitch) such as 18 NC 3A while the threads on portion 204 and in bore 124 are of relatively coarse size (large pitch) such as 28 NF-3A. During rotation of adjustment screw means 200, doll rod members 130, 132 allow axial movement of annular plate 120 and blade means 160 (which is fixedly attached thereto) relative body member 102 while restraining rotational movement between the annular end plate 120, blade means 160 assembly and the body member 102. Thus, angular displacement of adjustment screw means 200 causes relatively larger axial displacement between adjustment screw portion 204 and blade means 160 which is threadingly associated therewith than the axial displacement between screw portion 202 and body member 102 which is threadingly associated therewith. The thread sizes and diameters are correlated with the circumferential spacing of detent slots 214 so as to provide a particular amount of axial displacement between the body member 102 and the blade means 160 per degree of rotation. In the presently preferred embodiment, rotation between adjacent detent slots causes approximately 0.003 inches of axial adjustment of the gap 192 between body member 102 and blade means 160.

Thus, the construction and design is such that the width of the gap can be discreetly adjusted without measuring tools simply by turning the adjustment screw means from one detent location to another detent location. The opposite surfaces 182 and 184 of blade means 160 and rotatable body member 102 are maintained in parallel relationship during rotational adjustment of screw means 200 due to coaction of a single adjustment screw 200 with aligned threaded holes 110 and 124 of the body member 102 and end plate member 120 which are bored perpendicular to parallel surfaces 182 and 184 respectively. The parallel relationship between surfaces 182 and 184 is also facilitated by the coaction between pins 130, 132 and associated mounting bores 114, 126 and 116, 128 respectively. In addition, the blade member can be removed and replaced without removal or disassembly of any of the other components simply through detachment of blade means hub portion 162 from end plate 120 by removal of set screw 171.

It is contemplated that the inventive concepts herein described may be variously otherwise embodied and it is intended that the appended claims be construed to include alternative embodiments of the invention except insofar as limited by the prior art.

What is claimed is:

1. A carton separating apparatus for separating a carton from a stack of cartons comprising:

a rotatable body means;

a drive shaft means connected to said rotatable body means;

a plate means mounted axially adjacent said body means;

a separating blade means attached to said plate means and having a side surface facing said body means and defining an axial gap therebetween adapted to receive a portion of a carton;

a single screw means supporting and connecting said plate means to said body means and including a first threaded portion of one thread pitch connected to said body means and a second threaded portion of another thread pitch connected to said plate means whereby rotation of said single screw means causes differential relative axial displacement of said plate means and said separating blade means whereby the length of said axial gap therebetween is adjustable by rotation of said single screw means.

2. The invention of claim 1 further comprising rotational restraint means operably associated with said plate means for preventing rotation of said plate means relative to said rotatable body means during rotation of said screw means.

3. The invention of claim 2 further comprising:

detent means associated with said single screw means to hold said screw means in selected incremental adjusted positions.

4. The invention of claim 3 wherein said detent means comprises:

a plurality of equally circumferentially spaced axially extending grooved surfaces on said screw means; and radially inwardly biased, circumferentially fixed ball means operably mounted in one of said plate means and said rotatable body means for engaging an oppositely positioned one of said grooved surfaces of said screw means whereby rotational movement of said screw means relative said biased ball means between circumferentially adjacent ones of said grooved surfaces produces a constant, incremental, axial displacement between said plate means and said rotatable body means.

5. The invention of claim 4 wherein said rotatable body means comprises a first carton engaging surface and wherein said separating blade means comprises a second carton engaging surface positioned opposite said first surface and parallel thereto and wherein said rotatable body means comprises a first threaded bore positioned perpendicular to said first surface and operatively associated with said first threaded portion of said single screw means and said separating blade means comprises a second threaded portion positioned perpendicular to said second surface and operatively associated with said second threaded portion of said single screw means whereby said parallel relationship between said first surface and said second surface is maintained during rotational adjustment of said single screw means.

* * * * *